US012384606B2

(12) United States Patent
Pawella et al.

(10) Patent No.: US 12,384,606 B2
(45) Date of Patent: Aug. 12, 2025

(54) LID ELEMENT AND CLOSURE ASSEMBLY FOR A BEVERAGE CONTAINER

(71) Applicant: Ardagh Metal Packaging Europe GmbH, Zug (CH)

(72) Inventors: Frank Pawella, Meckenheim (DE); Hajo Rieck, Hennef (DE); Udo Jöbges, Düren (DE)

(73) Assignee: Ardagh Metal Packaging Europe GmbH, Zug (CH)

( * ) Notice: Subject to any disclaimer, the term of this patent is extended or adjusted under 35 U.S.C. 154(b) by 43 days.

(21) Appl. No.: 18/551,836

(22) PCT Filed: Mar. 21, 2022

(86) PCT No.: PCT/EP2022/057375
§ 371 (c)(1),
(2) Date: Sep. 21, 2023

(87) PCT Pub. No.: WO2022/200286
PCT Pub. Date: Sep. 29, 2022

(65) Prior Publication Data

US 2024/0190625 A1 Jun. 13, 2024

(30) Foreign Application Priority Data

Mar. 22, 2021 (DE) ..... 10 2021 106 980.7

(51) Int. Cl.
*B65D 47/08* (2006.01)
*B65D 6/34* (2006.01)
(Continued)

(52) U.S. Cl.
CPC ..... *B65D 47/08* (2013.01); *B65D 7/40* (2013.01); *B65D 7/48* (2013.01); *B65D 53/00* (2013.01)

(58) Field of Classification Search
CPC ..... B65D 3/30; B65D 51/007; B65D 41/62; B65D 47/08; B65D 7/40; B65D 7/48; B65D 53/00
See application file for complete search history.

(56) References Cited

U.S. PATENT DOCUMENTS 3,287,053 A * 11/1966 Stec ..... B65D 17/506 222/545
7,918,359 B2 * 4/2011 Paris ..... B65D 17/506 220/254.9

(Continued)

FOREIGN PATENT DOCUMENTS

WO WO 2014/170140 10/2014
WO WO 2022/200286 9/2022

OTHER PUBLICATIONS

International Search Report; PCT/EP2022/057375; dated Jul. 15, 2022; 4 pages.

*Primary Examiner* — Kareen K Thomas
(74) *Attorney, Agent, or Firm* — Knobbe, Martens, Olson & Bear, LLP

(57) ABSTRACT

The invention relates to a lid element (1) for a beverage container (2), at least comprising a lid panel (3) having an opening (4), a fold edge (6) extending around the lid panel (3) in a circumferential direction (5) for connecting the lid element (1) to the beverage container (2), as well as damping bead (7) extending circumferentially between the fold edge (6) and the lid panel (3); wherein the lid element (1) has an outer face (8) and an inner face (9), and the opening (4) has an opening rim (10) and an opening plane (11) formed by the opening rim (10); wherein the lid element (1) has a connection region (12) which directly adjoins the opening rim (10), extends around the opening rim (10) in the circumferential direction (5), and extends at least in part at an angle of inclination (13).

13 Claims, 3 Drawing Sheets

Figure 1:
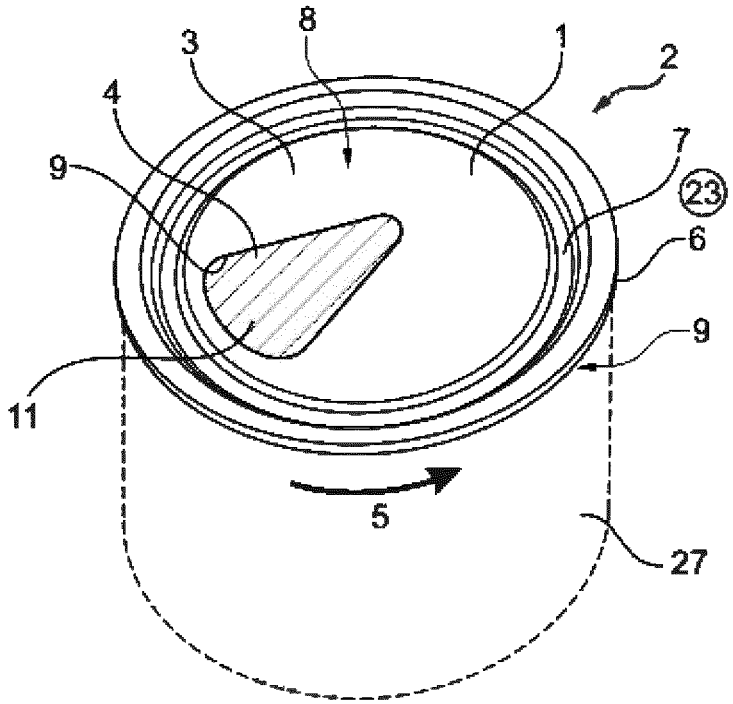

(51) Int. Cl.
*B65D 6/40* (2006.01)
*B65D 53/00* (2006.01)

(56) References Cited

U.S. PATENT DOCUMENTS

| | | | | |
|---|---|---|---|---|
| 8,240,498 | B2 * | 8/2012 | Ramsey | B65D 17/4014 220/254.1 |
| 2006/0201944 | A1 | 9/2006 | Shibasaka et al. | |
| 2009/0173737 | A1 * | 7/2009 | Ramsey | B21D 51/443 220/361 |

* cited by examiner

LID ELEMENT AND CLOSURE ASSEMBLY FOR A BEVERAGE CONTAINER

The present invention concerns a lid element for a beverage container, and a closure assembly for a beverage container, in particular a beverage can.

The lid element has an opening, a folded rim extending around the lid panel in a circumferential direction for connecting to the beverage container, and a damping bead extending circumferentially between the folded rim and the lid panel. The lid element furthermore has an outside and an inside, and the opening has an opening rim and an opening plane formed by the opening rim.

The closure assembly comprises a lid element, in particular the described lid element, with an opening and a closure element arranged non-releasably on the lid element for repeatable, in particular gas-tight closure of the opening.

The lid element is in particular made of metal. The beverage container serves for storing a content, e.g. a fluid, wherein in the closed state the beverage container is under a positive pressure.

In particular in beverage cans with carbonated contents, the beverage container may stand under an internal pressure of up to 6.2 bar before first opening.

To close such beverage containers, closure assemblies are known both for opening once only and for repeated closure. The advantage of a resealable closure assembly is evident. With this, a beverage container may also be closed again, in particular gas-tightly, after partial emptying so as to prevent an escape of the fluid stored in the beverage container and, in particular with carbonated contents, a loss of carbonation.

In particular, a captive arrangement of the closure assembly on the lid element or on the beverage container is desired, so that all constituents of the beverage container can be subjected to a recycling process.

The subsequently published document DE 10 2020 114 863.1 describes a closure assembly with a toggle mechanism.

There is a constant need to improve the lid elements and closure assemblies of beverage containers and match these to one another.

The object of the invention is to at least partly solve the problems present in the prior art and in particular to provide a lid element which is suitable for use with a resealable closure element. With the closure element, a closure assembly is provided for a beverage container, using which the beverage container can be repeatedly resealed, in particular gas-tightly.

In particular, a closure element of the closure assembly is captively arranged or attached to the beverage container.

Also, where applicable after first opening, resealing of the beverage container by the closure assembly is possible, wherein a seal of the beverage container (against atmospheric pressure) can be guaranteed firstly in the case of a lower pressure in the beverage container and secondly even at a pressure of up to 6.2 bar inside the beverage container.

These objects are achieved with a lid element according to the features of claim 1. Further advantageous embodiments of the lid element are indicated in the dependent claims. It is pointed out that the features listed individually in the dependent claims may be combined with one another in any technologically suitable fashion and define further embodiments of the invention. In addition, the features indicated in the claims are specified and explained in more detail in the description, wherein further preferred embodiments of the invention are illustrated.

A lid element for a beverage container contributes to this. The lid element has at least a lid panel with an opening, a folded rim extending around the lid panel in a circumferential direction for connecting to the beverage container, and a damping bead extending circumferentially between the folded rim and the lid panel. The lid element has an outside and an inside, and the opening has an opening rim and an opening plane formed by the opening rim. The lid element has a connecting region which directly adjoins the opening rim, runs around the opening rim in the circumferential direction, and extends (at least partially) at a slope angle, wherein the slope angle can be determined in a cross-section, running perpendicularly to the opening plane and perpendicularly to the opening rim, between the opening plane and a tangent lying against the outside or the inside at the connecting region. The slope angle is more than zero angular degrees.

In particular, the lid element is a known lid, e.g. of a beverage can, which is or can be connected to the beverage can. Preferably, the lid element is connected inseparably (only destructively) to the beverage container or is connected therewith for correct use of the beverage container, in particular via the folded rim. In particular, the lid element consists of metal or a metal alloy. The material of the lid element in particular has a material thickness of 0.15 millimeters to 1.0 millimeters, preferably between 0.15 millimeters and 0.3 millimeters. The lid element is produced in particular by shaping, e.g. deep-drawing. The opening in the lid element is in particular produced by punching.

The inside of the lid element forms the side of the lid element facing the content of the beverage container, wherein the outside of the element forms the side of the element facing away from the content.

The opening of the lid element is in particular simultaneously the (only) outlet opening for a content of the beverage container. The shape of the opening is in particular not established. The opening is in particular rotationally symmetrical or not rotationally symmetrical.

The lid element is preferably a ready-formed metal lid originating from a production process. It is rather to be combined as a shell (blank), namely preprepared, with a closure element into a closure assembly in order then, in this combination, to resealably close a body of the beverage container, which is not described in more detail here since these bodies are generally known and available as standard.

The design of a lid element with folded rim (for connection to the in particular cylindrical body of the beverage container) and damping bead is generally known. Also it is known to arrange the opening, for arrangement of a closure element, in the region of the usually flat lid panel. The opening rim here extends in a cross-section running perpendicularly to the opening plane and perpendicularly to the opening rim, usually parallel with the opening plane and in some cases parallel with the lid panel.

It is now proposed that a connecting region, which is provided for connection of the closure element to the lid element, extends at least partly at a slope angle. The slope angle can be determined in a cross-section, running perpendicularly to the opening plane and perpendicularly to the opening rim, between the opening plane and a tangent lying against the outside or the inside at the connecting region. The connecting region thus extends in particular not parallel to the opening plane but at an angle thereto.

Thus, firstly, a reinforcement of the connecting region can be achieved. This reinforcement leads to a design of the lid element which retains its form for a user, especially in the case of a resealable closure element and the associated repeated actuation of the closure element.

Secondly, it can thus be ensured that the opening rim extends into a sealing material of the closure element or, when the closure element is arranged in the opening, the opening rim is pressed into the sealing material. Thus the cut edge of the lid element formed by the opening rim can be covered or sealed with the sealing material. The closure element can thus be arranged captively on the lid element via a frame permanently contacting the opening rim.

In particular, a cut edge at the opening rim runs in an axial direction, i.e. in a direction running transversely to the radial direction. This cut edge is in particular formed by punching tool which is advanced in the radial direction to form the cut edge. After punching, the resulting cut edge is in particular bent further, so that the cut edge runs sloping from the axial direction towards the radial direction. In particular, the cut edge runs at a cut edge angle of at least 20 angular degrees, preferably at least 30 angular degrees to the axial direction.

The cut edge, arranged sloping relative to the axial direction, allows the edges of the cut edge, i.e. the transition between the outside and the cut edge (first edge) and the transition between the inside and the cut edge (second edge), to be pressed into the sealing material so that sealing material also extends beyond first edge to the outside.

Thus in particular there are no regions of the opening rim of the lid element accessible externally or to a user of the beverage container. This applies in particular for every state of a closure element arranged in the opening of the lid element.

In particular, the connecting region extends, starting from the in particular flat lid plane surrounding the connecting region, up to the opening rim towards the inside of the lid element.

In particular, the slope angle is at least 10 angular degrees, preferably at least 20 angular degrees, particularly preferably at least 30 angular degrees. In particular, a smallest slope angle of the connecting region is at least 10 angular degrees, preferably at least 20 angular degrees, particularly preferably at least 30 angular degrees.

In particular, the slope angle is at most 90 angular degrees, preferably at most 70 angular degrees, particularly preferably at most 60 angular degrees.

Preferably, the slope angle is between less than 90 angular degrees and 75 angular degrees, preferably between less than 90 angular degrees and 85 angular degrees.

In particular, the connecting region is designed symmetrically in the circumferential direction, i.e. the course of the connecting region is in particular the same in all cross-sections.

In particular, a first portion of the connecting region, adjoining the opening rim in a radial direction, in the cross-section extends at the slope angle.

In particular, the first portion has an extent of at least 0.2 millimeters, preferably at least 0.4 millimeters, in the radial direction. In particular, the first portion has an extent in the radial direction of most 2.0 millimeters, preferably at most 1.0 millimeter.

The radial direction extends in every cross-section, running perpendicularly to the opening plane and perpendicularly to the opening rim, starting from the opening up to the folded rim.

In particular, the first portion extends, in particular in the radial direction, up to a second portion which runs parallel to the opening plane in the cross-section. The second portion is in particular part of the lid panel.

The connecting region between the first portion and the second portion may e.g. have a (further) damping bead, where applicable running around in the circumferential direction.

In particular, in the cross-section and in the first portion, the slope angle varies but is more than zero angular degrees at every position. The first portion may e.g. have a curved course in the cross-section. The first portion may however also at least partly have a straight course and partly a curved course.

In particular, in the cross-section and in the first portion, the slope angle has a constant angular amount.

The transition between the first portion and the second portion may be configured as an edge or as a curving course.

In particular, in the first portion, the slope angle present at a position in the radial direction is constant in the circumferential direction.

Furthermore, a closure assembly for a beverage container is proposed. The closure assembly comprises at least the described lid element and a closure element arranged on the lid element for closing the opening. The closure element with the opening rim forms a sealing face, via which the beverage container can be sealed gas-tightly against an environment.

The closure element in particular comprises all components which serve for temporary and repeatable opening and closing of the beverage container. In particular, the closure element comprises e.g. a frame or frame part which is arranged on the opening. Via the frame or frame part, the closure element is permanently attached to the lid element. This frame or frame part contains in particular a window via which fluid can be extracted from the beverage container. The closure element furthermore comprises e.g. a cover or a flap which is pivotable relative to the frame or frame part so as to allow repeatable opening and closing of the beverage container.

In particular, the opening rim extends into a sealing material, wherein the sealing material is arranged on the inside and also on the outside of the lid element. The opening rim with the sealing material thus in particular forms the sealing face.

Preferably, the sealing material comprises a plastic with a Shore A hardness of maximum 16, in particular maximum 45, preferably maximum 35.

In particular, the closure element has a stop face which lies against the inside and contains the opening in the circumferential direction, wherein the sealing face is arranged on the stop face.

In particular, the closure element is attached non-releasably to the lid element. In particular, the closure element is attached non-releasably via the sealing material to the opening rim or to the connecting region of the lid element.

In particular, the closure element can be preassembled independently of the lid element and captively arranged on the lid element as a preassembled component. The closure element is in particular connected to the lid element exclusively by the connecting region. In particular, the closure element is arranged on the lid element from the inside and extends at least partially over the opening to the outside. After arrangement, a dedicated region of the closure element may be e.g. thermally shaped, so that the closure element is connected by form fit to the opening rim.

In particular, the closure element allows a repeatable gas-tight closure of the opening.

Furthermore, a use of the described closure assembly is proposed for repeatable fluid-tight closing (and opening) of a beverage container, in particular a beverage can.

Furthermore, a method is proposed for production of the lid element. Here, the opening is formed by a punching process and then the opening rim with the cut edge is shaped further. Thus the cut edge can be arranged sloping relative to the axial direction.

The statements relating to the lid element apply similarly to the closure assembly and the use of the closure element, and vice versa.

The use of the indefinite article (a, an), in particular in the claims and the associated description, should be regarded as such and not as a numerical value. Accordingly, concepts or components introduce therewith should be understood to mean that these are present at least once and in particular may also be present in multiples.

As a precaution, it is pointed out that the ordinal terms used here ("first", "second") serve primarily only to distinguish multiple identical objects, values or processes, i.e. do not necessarily indicate a dependency and/or order of these objects, values or processes. If a dependency and/or order is however necessary, this is explicitly indicated or arises evidently for the person skilled in the art when studying the actual embodiment described. If a component may be present in multiples (at least one), the description for one of these components applies analogously for all or some of the plurality of these components, but this is not mandatory.

Figure 2:
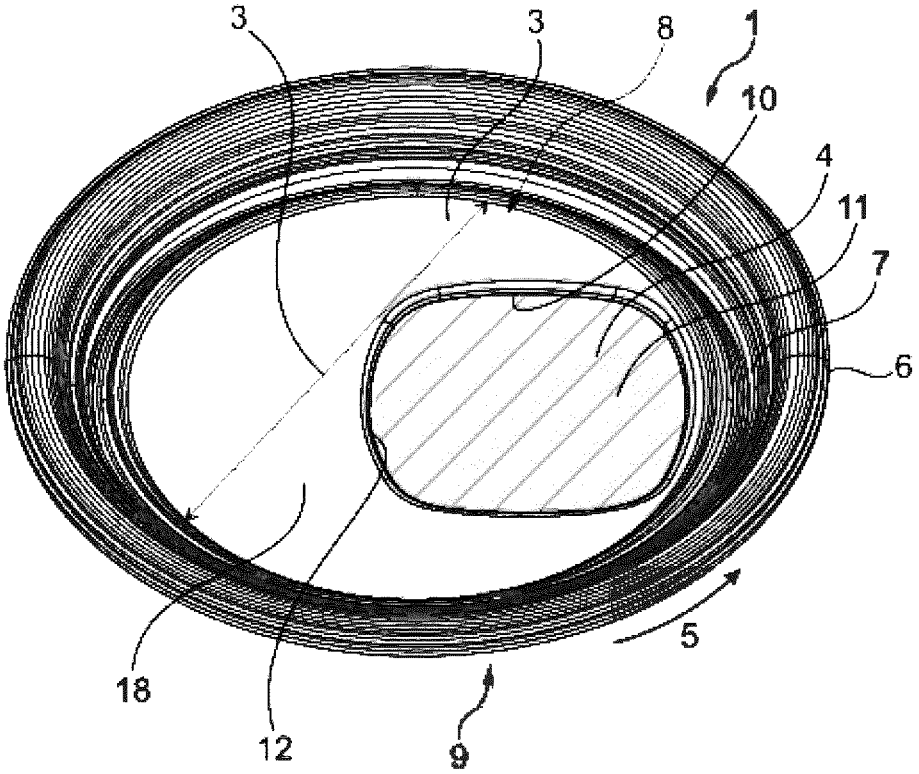
Figure 3:
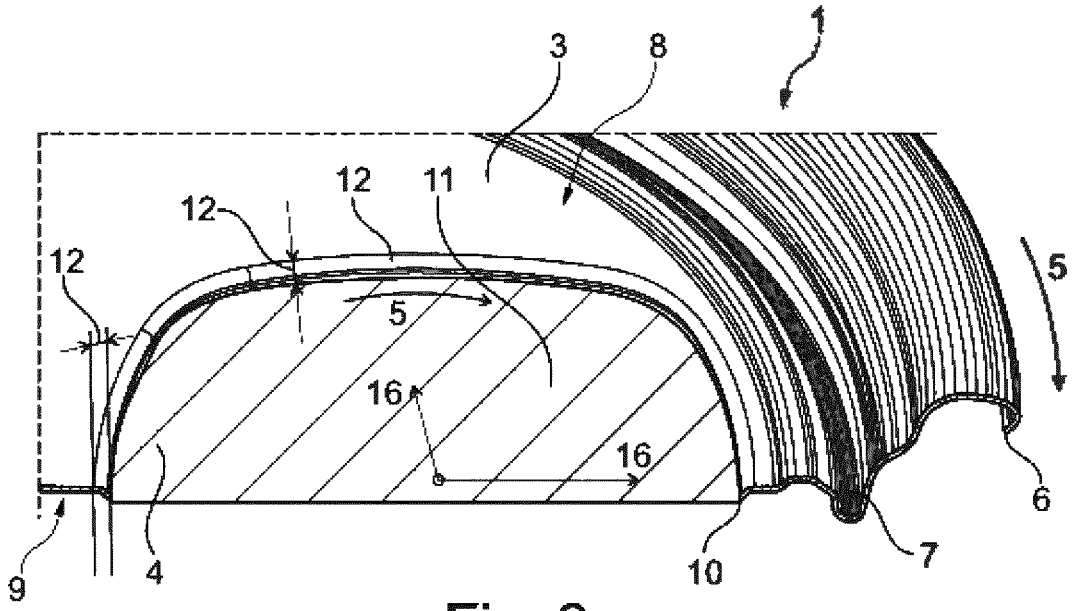
Figure 4:
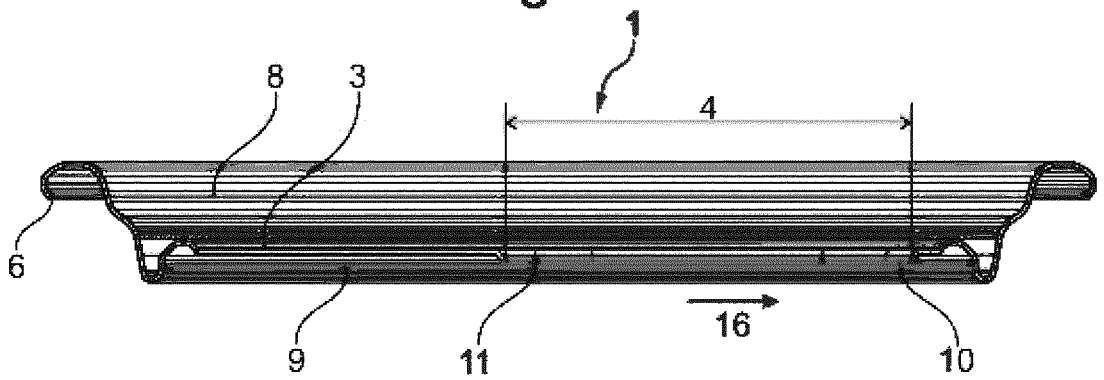
Figure 5:
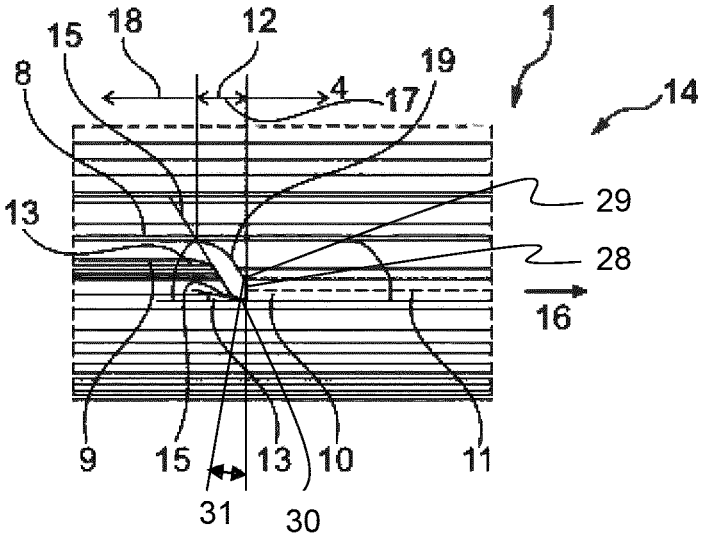
Figure 6:
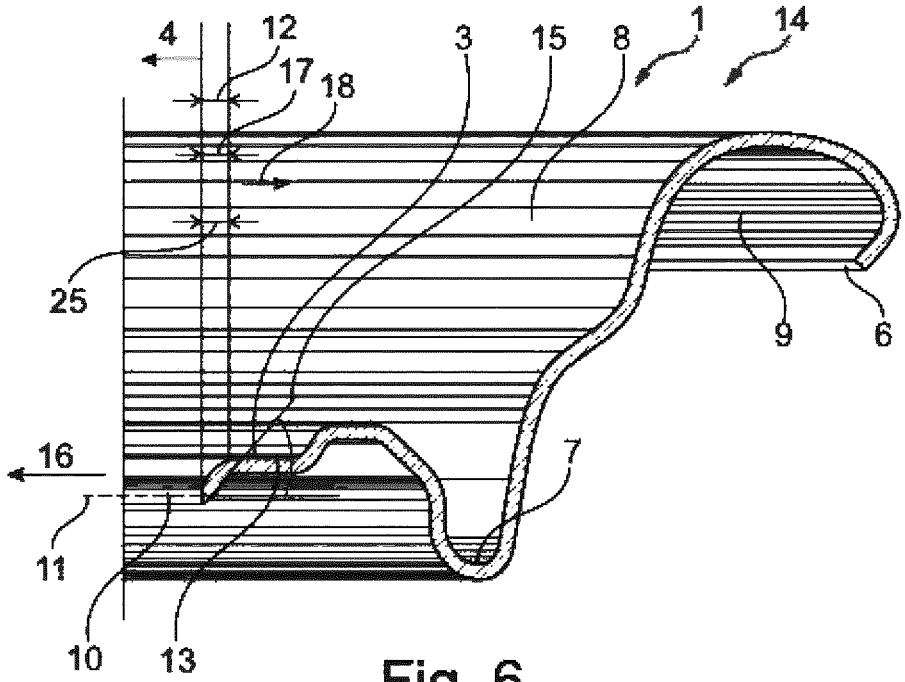

The invention and the technical environment are explained in more detail below with reference to the appended figures. It is pointed out that the invention is not restricted by the exemplary embodiments described. In particular, unless explicitly specified otherwise, it is also possible to extract partial aspects of the elements presented in the figures and combine these with other constituents and findings from the present description. In particular, it is pointed out that the figures, and in particular the size ratios illustrated therein, are purely schematic. In the drawings:

FIG. 1: shows a beverage container with a lid element in a perspective view;

FIG. 2: shows a lid element in a perspective view;

FIG. 3: shows the lid element from FIG. 2 in cross-section in a perspective view;

FIG. 4: shows a lid element from FIG. 3 in a side view;

FIG. 5: shows a first extract of the view in FIG. 4;

FIG. 6: shows a second extract of the view in FIG. 4; and

Figure 7:
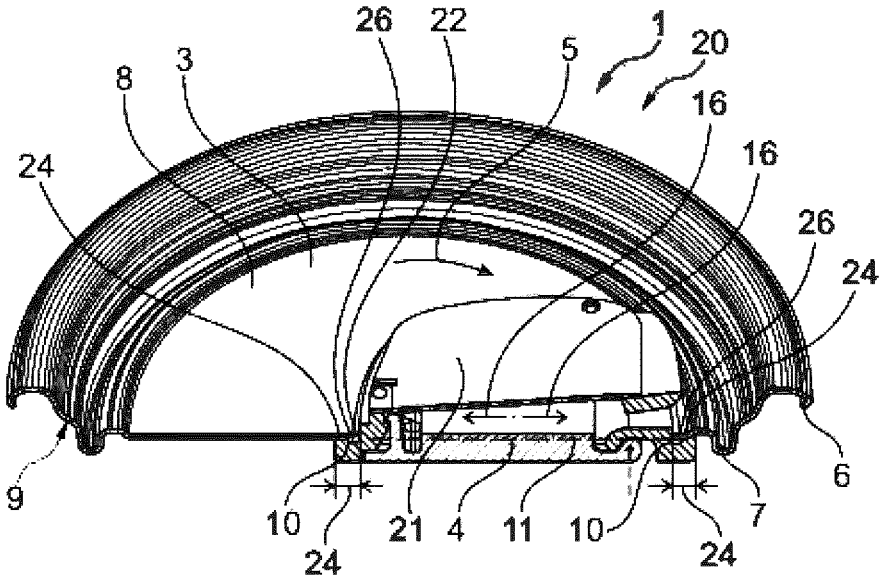

FIG. 7: shows a closure assembly in a cross-sectional perspective view.

FIG. 1 shows a beverage container 2 with a lid element 1 in a perspective view. The lid element 1 has an outside 8 and an inside 9, and an opening 4. The opening 4 has an opening rim 10 and an opening plane 11 formed by the opening rim 10. The lid element 1 is or can be connected to the body 27 of a beverage container 2. The lid element 1 is inseparably (only destructively) connected to the beverage container 2 via a folded rim 6. The inside 9 of the lid element 1 forms the side of the lid element 1 facing the content of the beverage container 2, wherein the outside 8 of the lid element 1 forms the side of the lid element 1 facing away from the content and towards an environment 23. The opening 4 of the lid element 1 is the only outlet opening for the content of the beverage container 2.

FIG. 2 shows a lid element 1 in a perspective view. FIG. 3 shows the lid element 1 from FIG. 2 in cross-section in a perspective view. FIG. 4 shows the lid element 1 from FIG. 3 in a side view. FIG. 5 shows a first extract of the view in FIG. 4. FIG. 6 shows a second extract of the view in FIG. 4. FIGS. 2 to 6 are described jointly below. Reference is made to the statements relating to FIG. 1.

The lid element 1 has a lid panel 3 with an opening 4, a folded rim 6 running around the lid panel 3 in a circumferential direction 5 for connection to the beverage container 2, and a damping bead 7 extending circumferentially between the folded rim 6 and the lid panel 3. The lid element 1 has an outside 8 and an inside 9, and the opening 4 has an opening rim 10 and an opening plane 11 formed by the opening rim 10. The lid element 1 has a connecting region 12 which directly adjoins the opening rim 10 and runs around the opening rim 10 in the circumferential direction 5, and extends at least partly at a slope angle 13, wherein the slope angle 13 can be determined in a cross-section 14, running perpendicularly to an opening plane 11 and perpendicularly to the opening rim 10, between the opening plane 11 and a tangent 15 lying against the outside 8 or inside 9 in the connecting region 12. The slope angle 13 is more than zero angular degrees.

The lid element 1 is inseparably (only destructively) connected to the beverage container 2, or is connected therewith via the folded rim 6 for correct use of the beverage container 2.

The connecting region 12 extends from the flat lid panel 3 surrounding the connecting region 12, and up the opening rim 10 towards the inside 9 of the lid element 1.

The slope angle directly at the opening rim 10 amounts to around 10 angular degrees, and in the first portion 17 is at most 60 angular degrees.

The connecting region 12 is designed symmetrically in the circumferential direction 5, i.e. the course of the connecting region 12 is the same in all cross-sections 14. Thus in the first portion 17, the slope angle 13 present at a position 19 in the radial direction 16 is constant in the circumferential direction 5.

A first portion 17 of the connecting region 12 adjoining the opening rim 10 in the radial direction 16 extends in the cross-section 14 at the slope angle 13, wherein the first portion 17 has an extent 25 in the radial direction 16 of around one millimeter.

The first portion 17 extends in the radial direction 16 up to a second portion 18 which, in the cross-section 14, runs parallel to the opening plane 11. The second portion 18 is part of the lid panel 3.

In the cross-section 14 and in the first portion 17, the slope angle 13 varies but is more than zero angular degrees at every position 19. The first portion 17 has a curving course in the cross-section 14.

The transition between the first portion 17 and the second portion 18 is configured as a curve.

A cut edge 28 runs on the opening rim 10 in an axial direction, i.e. in a direction running transversely to the radial direction 16. This cut edge 28 is formed by a punching tool which advances in the axial direction to form the cutting edge 28. After punching, the resulting cut edge 28 is bent further so that the cut edge 28 runs sloping from the axial direction towards the radial direction 16 at a cut edge angle 31 of 20 angular degrees relative to the axial direction (only illustrated in FIG. 5).

The cut edge 28, arranged at an angle to the axial direction, allows the edges of the cut edge 28, i.e. the transition between the outside 8 and the cut edge 28 (first edge 29) and the transition between the inside 9 and the cut edge 28 (second edge 30), to be pressed into the sealing material 26 so that the sealing material 26 also extends beyond the first edge 29 towards the outside 8.

FIG. 7 shows a closure assembly 20 in a cross-sectional perspective view. Reference is made to the statements relating to FIGS. 1 to 6.

The closure assembly 20 comprises the described lid element 1 and a closure element 21 arranged on the lid element 1 for closing the opening 4. The closure element 21 with the opening rim 10 forms a sealing face 22, via which the beverage container 2 can be sealed gas-tightly against an environment 23.

The opening rim 10 extends into a sealing material 26, wherein the sealing material 26 is arranged on the inside 9 and also on the outside 8 of the lid element 1. The opening rim 10 with the sealing material 26 forms the sealing face 22.

The closure element 21 has a stop face 24 which lies permanently against the inside 9 and surrounds the opening 4 in the circumferential direction 5, wherein the sealing face 22 is arranged on the stop face 24.

The closure element 21 is attached non-releasably via the sealing material 26 to the opening rim 10 or the connecting region 12 of the lid element 1. The closure element 21 allows a repeatable gas-tight closure of the opening 4.

List of Reference Signs

| | |
|---|---|
| 1 | Lid element |
| 2 | Beverage container |
| 3 | Lid panel |
| 4 | Opening rim |
| 5 | Circumferential direction |
| 6 | Folded rim |
| 7 | Damping bead |
| 8 | Outside |
| 9 | Inside |
| 10 | Opening rim |
| 11 | Opening plane |
| 12 | Connecting region |
| 13 | Slope angle |
| 14 | Cross-section |
| 15 | Tangent |
| 16 | Radial direction |
| 17 | First portion |
| 18 | Second portion |
| 19 | Position |
| 20 | Closure assembly |
| 21 | Closure element |
| 22 | Sealing face |
| 23 | Environment |
| 24 | Stop face |
| 25 | Extent |
| 26 | Sealing material |
| 27 | Body |
| 28 | Cut edge |
| 29 | First edge |
| 30 | Second edge |
| 31 | Cut edge angle |

The invention claimed is:

1. A closure assembly for a beverage container, comprising:

a lid; and a closure arranged on the lid for closing an opening;

wherein the lid comprises a lid panel with the opening, a folded rim extending around the lid panel in a circumferential direction for connecting the lid to the beverage container, and a damping bead extending circumferentially between the folded rim and the lid panel;

wherein the lid comprises an outside and an inside;

wherein the opening comprises an opening rim and an opening plane formed by the opening rim;

wherein the lid further comprises a connecting region adjacent the opening rim;

wherein the lid extends at least partially at a slope angle;

wherein the slope angle can be determined in a cross-section, the cross-section being perpendicular to the opening plane and the opening rim;

wherein the slope angle is measured between the opening plane and a tangent lying against either the outside of the lid or the inside of the lid;

wherein the slope angle is more than zero angular degrees;

wherein the opening rim forms a sealing face forming a gas-tight seal against an environment;

wherein the closure is arranged on the lid from the inside and extends at least partially over the opening to the outside;

wherein the connecting region adjoins the opening rim in a radial direction at a first portion;

wherein the first portion extends at the slope angle; and wherein the first portion has an extent of at least 0.2 millimeters in the radial direction.

2. The closure assembly of claim 1, wherein the slope angle is at least 10 angular degrees.

3. The closure assembly of claim 1, wherein the slope angle is at most 90 angular degrees.

4. The closure assembly of claim 1, wherein the first portion extends up to a second portion which runs parallel to the opening plane in the cross-section.

5. The closure assembly of claim 1, wherein the slope angle is not constant but is more than zero angular degrees at every position.

6. The closure assembly of claim 1, wherein, in the cross-section and in the first portion, the slope angle is consistent.

7. The closure assembly of claim 1, wherein in the first portion, the slope angle is constant.

8. The closure assembly of claim 1, wherein the connecting region is formed symmetrically in the circumferential direction so that the connecting region has a constant extent in all cross-sections.

9. The closure assembly of claim 1, wherein the lid further comprises a sealing material;

wherein the opening rim extends into the sealing material; and wherein the sealing material is arranged on the inside and also on the outside of the lid.

10. The closure assembly of claim 1, wherein the lid further comprises a sealing material;

wherein the opening rim extends into the sealing material of the closure; and wherein when the closure is arranged in the opening, the opening rim can be pressed into the sealing material.

11. The closure assembly of claim 1, wherein the closure further comprises a stop face on the inside of the lid;

wherein the stop face is adjacent the opening; and wherein the sealing face is arranged on the stop face.

12. The closure assembly of claim 1, wherein the closure is attached non-releasably to the lid.

13. The closure assembly of claim 1, wherein the closure allows a repeatable gas-tight closure of the opening.

* * * * *